US008556782B2

(12) United States Patent
Cen

(10) Patent No.: US 8,556,782 B2
(45) Date of Patent: Oct. 15, 2013

(54) FITNESS BARBELL

(75) Inventor: Jianli Cen, Yuyao (CN)

(73) Assignee: Qing CEN, Yuyao, Zhejiang Province (CN)

( * ) Notice: Subject to any disclaimer, the term of this patent is extended or adjusted under 35 U.S.C. 154(b) by 0 days.

(21) Appl. No.: 13/576,171

(22) PCT Filed: Apr. 29, 2011

(86) PCT No.: PCT/CN2011/073496

§ 371 (c)(1), (2), (4) Date: Jul. 31, 2012

(87) PCT Pub. No.: WO2012/055226

PCT Pub. Date: May 3, 2012

(65) Prior Publication Data

US 2012/0302411 A1 Nov. 29, 2012

(30) Foreign Application Priority Data

Dec. 22, 2010 (CN) ..... 2010 2 0692942 U

(51) Int. Cl.
*A63B 21/072* (2006.01)
*A63B 21/075* (2006.01)

(52) U.S. Cl.
USPC ..... 482/106; 482/107; 482/108

(58) Field of Classification Search
USPC ..... 482/92, 93, 106, 107, 108, 141, 139, 482/50, 49
See application file for complete search history.

(56) References Cited

U.S. PATENT DOCUMENTS

| | | | | |
|---|---|---|---|---|
| 4,482,151 | A | 11/1984 | Zwilling | |
| 4,566,690 | A | 1/1986 | Schook | |
| 5,184,993 | A * | 2/1993 | Dowdeswell | 482/106 |
| 5,484,367 | A | 1/1996 | Martinez | |
| 5,741,206 | A * | 4/1998 | Anastasi | 482/105 |
| 7,238,147 | B2 * | 7/2007 | Mills et al. | 482/106 |
| 7,862,486 | B1 * | 1/2011 | Watson | 482/106 |
| 2003/0207740 | A1 | 11/2003 | Fenelon et al. | |
| 2005/0187079 | A1 * | 8/2005 | Diakonov et al. | 482/106 |
| 2005/0227831 | A1 * | 10/2005 | Mills et al. | 482/106 |
| 2009/0075792 | A1 * | 3/2009 | Stugart | 482/93 |

FOREIGN PATENT DOCUMENTS

CN 2469939 Y 1/2002

* cited by examiner

*Primary Examiner* — Oren Ginsberg
*Assistant Examiner* — Sundhara Ganesan
(74) *Attorney, Agent, or Firm* — The Webb Law Firm

(57) ABSTRACT

The invention discloses a fitness barbell comprising a holding rod and a gravity body, the gravity body is a ring-shaped gravity fitness ring, a handle arranged in the diameter direction of the ring-shaped gravity fitness ring is arranged in the ring-shaped gravity fitness ring, the holding rod is fastened detachably with the ring-shaped gravity fitness ring through a connecting mechanism composed of a fixing seat and a fastening lock, and the ring-shaped gravity fitness ring is limited between the fixing seat and the lock body of the fastening lock through the lock tongue of the fastening lock. The invention has the following advantages: through the adoption of the ring-shaped gravity fitness ring as the gravity body, multiple purposes can be achieved, and materials are saved; and due to the application of the fastening lock, the gravity body is convenient to mount and detach, and the fastening effect is better.

12 Claims, 4 Drawing Sheets

FITNESS BARBELL

TECHNICAL FIELD

The invention relates to a fitness device, in particular to a fitness barbell employing a ring-shaped gravity fitness ring as the gravity body.

BACKGROUND ART

In the prior art, the fitness barbell employs a disc-shaped gravity body, which cannot be used for other fitness purposes rather than as the barbell's gravity body, causing the waste of materials.

SUMMARY OF THE INVENTION

To overcome the said defects in the prior art, the fitness barbell employs a ring-shaped gravity fitness ring as its gravity body to achieve multiple purposes and save materials. The ring-shaped gravity fitness ring is a ring-shaped gravity body, and a gravity fitness ring handle is positioned in the radial direction in the ring-shaped gravity body.

The fitness barbell comprises a holding rod and a gravity body, the gravity body is a ring-shaped gravity fitness ring, a handle arranged in the diameter direction of the ring-shaped gravity fitness ring is positioned in the ring-shaped gravity fitness ring, the holding rod is fastened detachably with the ring-shaped gravity fitness ring through a connecting mechanism composed of a fixing seat and a fastening lock, and the ring-shaped gravity fitness ring is limited between the said fixing seat and the lock body of the fastening lock through the lock tongue of the fastening lock.

According to a preferred embodiment, the fixing seat is in the shape of a stepped cylinder, the low step cylinder of the fixing seat is provided with a groove in the diameter direction and sleeved by the ring-shaped gravity fitness ring, the gravity fitness ring handle is clamped in the groove, a lock hole lug is arranged on the outer end surface of the fixing seat, a lock hole lug counter bore is formed on the lower end surface of the lock hole lug, a lock body inner end surface counter bore for accommodating the lock hole lug is formed on the lock body, and a through hole matched in dimensions with the lock hole lug counter bore is formed on the lower wall of the lock body inner end surface counter bore; the lock tongue is arranged in the lock body outer end surface counter bore, the lock tongue inner end surface is closely attached to the bottom surface of the lock body outer end surface counter bore and capable of sliding up and down in the counter bore, and lock tongue return springs are arranged between the lower end surface of the lock tongue and the lower wall surface of the lock body outer end surface counter bore; the return springs push the lock tongue to move up to enable the upper end of the lock tongue to penetrate the through hole to be inserted into the lock hole lug counter bore, so the fixing seat is locked with the lock body; and when the gravity body is required to be detached, a downward force is applied to the lock tongue to compress the return spring and separate the upper end of the lock tongue from the lock hole lug counter bore, so the fixing seat is separated from the lock body.

According to the preferred embodiment, lock tongue opening guide surfaces are symmetrically arranged on two sides at the lower part of the lock tongue, an open button is arranged at the outer end of the lock tongue, and button opening guide surfaces are arranged in the positions on two sides of the open button corresponding to the lock tongue opening guide surfaces; and since the lock tongue opening guide surfaces and the button opening guide surfaces are arranged in a butt joint manner, a horizontal, inward force applied on the open button can be converted into a downward force to the lock tongue to separate the fixing seat from the lock body.

According to the preferred embodiment, a lock body counter bore lug is arranged in the middle of the bottom surface of the lock body outer end surface counter bore, a strip-shaped through hole is formed in the corresponding position in the middle of the lock tongue, an open button return spring lug is correspondingly arranged in the middle of the inner end surface of the open button, a horizontally arranged open button return spring is arranged in a penetrating manner in the strip-shaped through hole, the lock body counter bore lug is sleeved by one end of the spring, and the open button return spring lug is sleeved by the other end of the spring.

According to the preferred embodiment, the fixing seat is provided with a hinge lug, a hinge notch for accommodating the hinge lug is formed in the corresponding position on the lower side edge of the lock body, and a hinge shaft is arranged in a penetrating manner on two sides of the hinge notch on the lock body and in the corresponding shaft hole on the hinge lug, so the lower side edge of the lock body is rotationally and movably connected with the fixing seat.

According to the preferred embodiment, a rotary return spring is arranged between the fixing seat and the lock body and is a cylindrical rotary torsion spring, the hinge shaft is sleeved by the spring, one end of the spring is in fastened connection with the fixing seat through a hinge return spring fixing groove, and the other end of the spring is in fastened connection with the lock body; and after unlocked from the fixing seat, the lock body rotates outwards around the hinge shaft to enable the inner end surface of the lock body to separate from the outer end surface of the fixing seat.

According to the preferred embodiment, a lock body outer end cover for enveloping the lock tongue and the open button is arranged at the outer end of the lock body, the lock body is in fastened connection with the lock body outer end cover, a through hole matched in dimensions with the open button is formed in the center of the lock body outer end cover, and claws are arranged at the upper and lower ends of the open button. When the fixing seat is locked with the lock body, the claws are propped against the inner edge of the through hole to prevent the open button from disengaging from the through hole.

According to the preferred embodiment, an end cover for making it easier to press the open button is arranged on the outer side of the through hole.

According to the preferred embodiment, an axial counter bore matched in diameter with the holding rod is formed at the axial center of the inner end surface of the fixing seat, and the end of the holding rod is inserted into the axial counter bore and fixedly connected with the axial counter bore through a pin.

According to the preferred embodiment, the part of the holding rod near the end is sleeved by a check ring for prompting the holding position.

Compared with the prior art, the invention has the following benefits:

1. Through the adoption of the ring-shaped gravity fitness ring as the gravity body, the fitness barbell can achieve multiple purposes and save materials;

2. Due to the application of the fastening lock, the gravity body is convenient to mount and detach.

The attached figures are labeled with the following marks: 1-Holding rod, 2-Check ring, 3-Fixing seat end cover, 31-Screws, 32-Screw hole plugs, 4-Fixing seat, 41-Fixing seat low step, 42-Gravity fitness ring handle groove, 43-Fixing seat lock hole lug counter bore, 44-Fixing seat hinge lug counter bore, 5-Gravity fitness ring, 51-Gravity fitness ring handle, 6-Pin, 7-Lock hole lug, 71-Lock hole lug counter bore, 8-Hinge lug, 81-Hinge lug shaft hole, 82-Hinge return spring fixing groove, 9-Screws, 100-Lock body, 101-Lock body screw holes, 102-Lock body inner end surface counter bore, 103-Lock body outer end surface counter bore, 104-Hinge mounting notch, 105-Hinge shaft hole, 106-Lock body outer end surface counter bore lug, 107-Lock body through hole, 110-Hinge shaft, 120-Rotary return spring, 130-Open button return spring, 140-Lock tongue, 141-Lock tongue guide surface, 142-Lock tongue opening guide surfaces, 143-Lock tongue slot hole, 150-Lock tongue return springs, 160-Open button, 161-Open button lug, 162-Open button claws, 163-Open button return spring lug, 164-Button opening guide surfaces, 170-Lock body outer end cover, 171-Lock body outer end cover through hole, 180-Open button end cover.

MODE OF CARRYING OUT THE INVENTION

With reference to the attached figures, a specific embodiment of the invention is provided in the below description. It should be understood that the protection scope of the invention is not limited by the specific embodiment.

Figure 1:
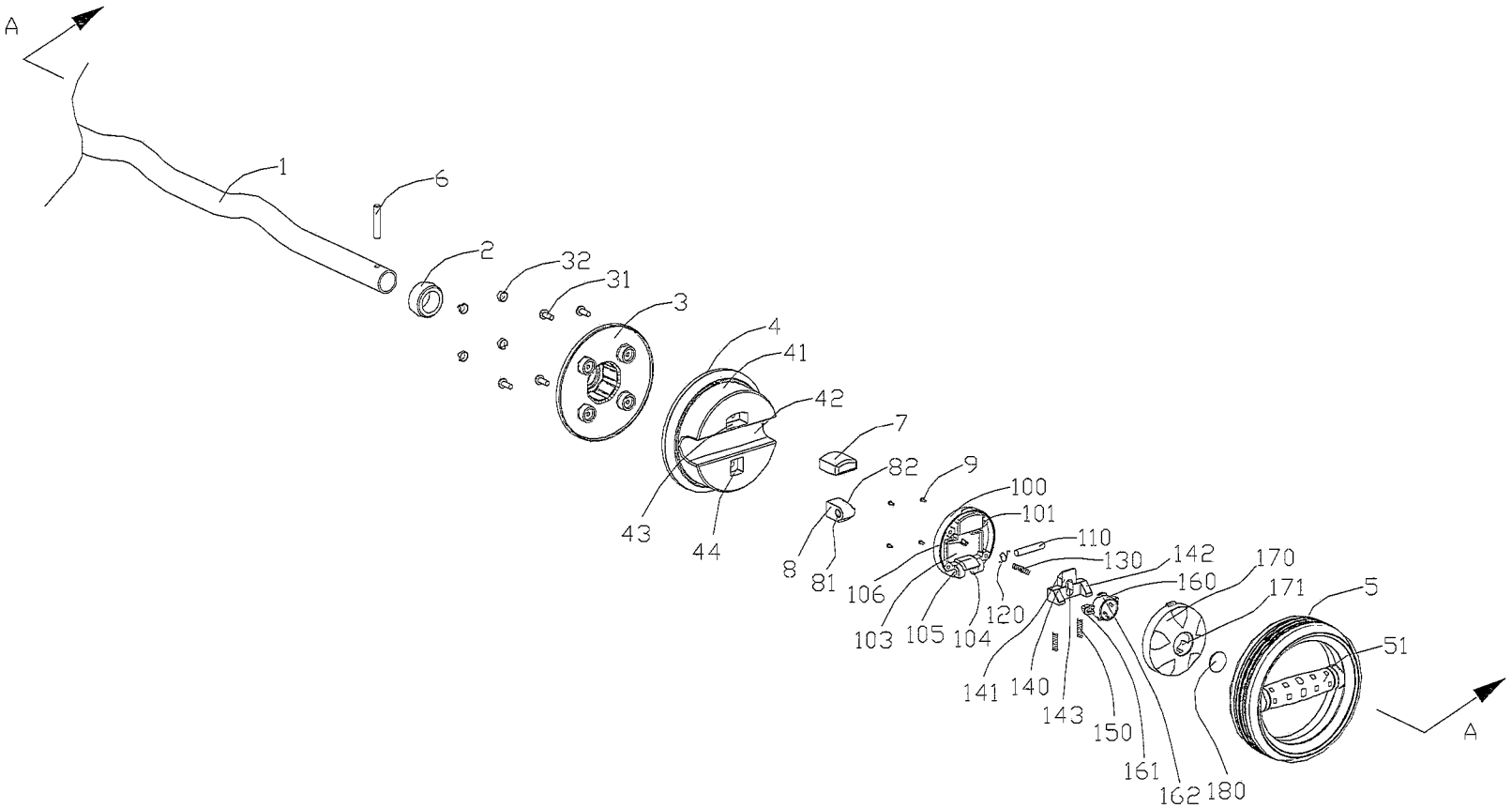
FIG. 1 is the exploded view of the fitness barbell (only one side of the barbell)
Figure 2:
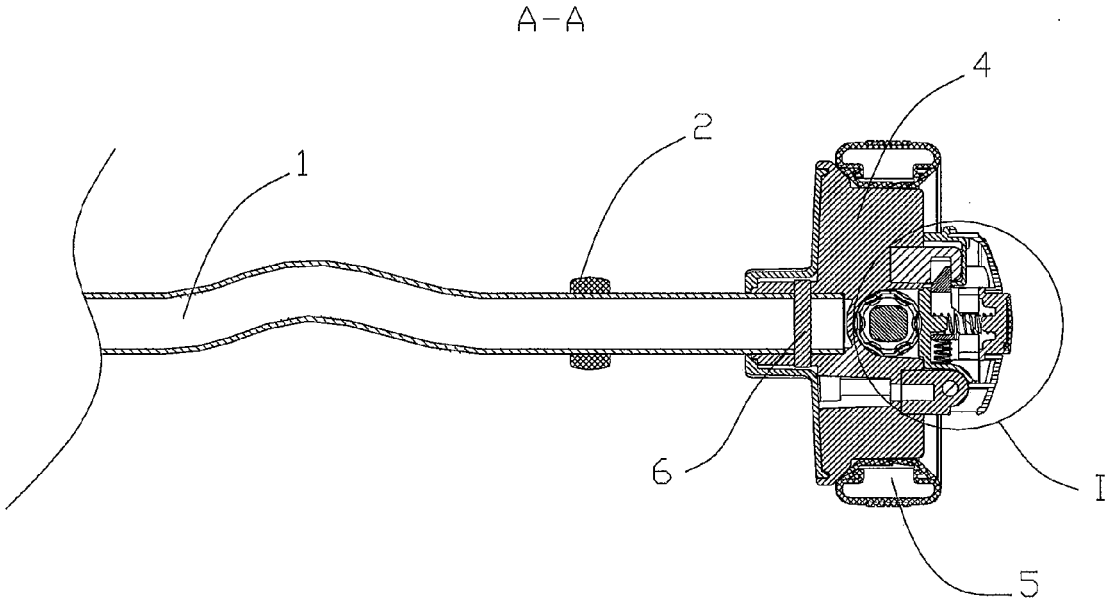
FIG. 2 is the A-A direction cut-open view of the fitness barbell assembled as FIG. 1.

As shown in FIG. 1-2, the fitness barbell comprises a holding rod 1 and a gravity body, wherein, the gravity body is a gravity fitness ring 5 with a ring-shaped structure, a handle 51 passing through the center of the ring-shaped gravity fitness ring is arranged in the ring-shaped gravity fitness ring, and the gravity fitness ring 5 is fastened and detached by a connecting mechanism composed of the fixing seat 4 and a fastening lock with respect to the fixing seat, so the holding rod 1 can be detachably fastened with the gravity body. The part of the holding rod 1 near the end is sleeved by a check ring 2 for prompting the holding position.

Figure 3:
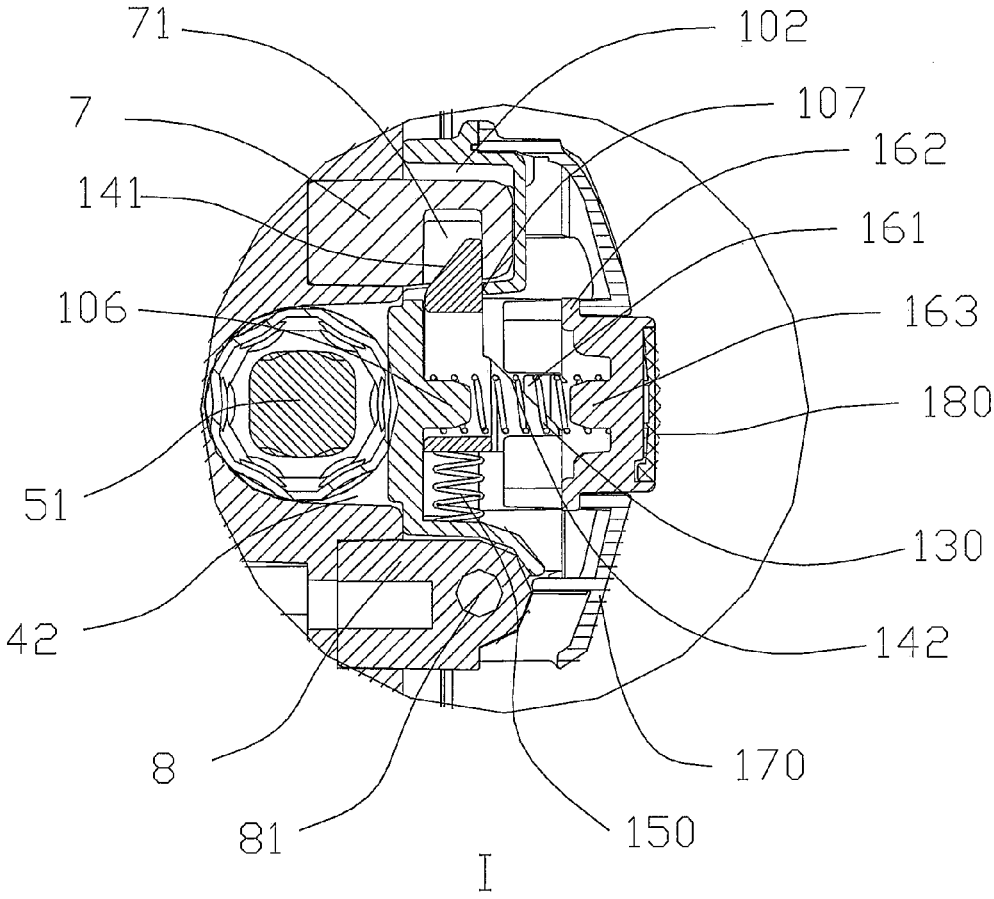
FIG. 3 is a partial enlargement view of the I position in FIG. 2.

Furthermore, as shown in FIG. 1-3, the barbell fixing seat 4 adopts a cylindrical structure, two end surfaces of the fixing seat face the barbell holding rod 1 and the gravity fitness ring 5 respectively, the end surface of the fixing seat 4 which faces the barbell holding rod 1 is the inner end surface, and the end surface of the fixing seat which faces the gravity fitness ring 5 is the outer end surface; an axial counter bore matched with the holding rod 1 in diameter is formed at the axial center of the inner end surface of the fixing seat 4, the diameter of the counter bore is matched with that of the holding rod 1, the holding rod 1 can be smoothly inserted into the counter bore and fixedly connected with the counter bore through a pin 6, the inner end surface of the fixing seat 4 is further covered with a fixing seat end cover 3 matched with the inner end surface, the fixing seat end cover 3 is in fastened connection with the fixing seat 4 through screws 31, and the screw holes on the fixing seat end cover 3 are complemented with screw hole plugs 32 to cover the screw holes for beautifying. The excircle part of the fixing seat 4 is double-step shaped, the inner end side of the fixing seat is the high step, the outer end side of the fixing seat is the low step 41, the diameter of the low step 41 is matched with the inside diameter of the gravity fitness ring 5, the low step 41 can be mutually sleeved with the gravity fitness ring, and the vertical surface of the step is propped against the end surface of the gravity fitness ring, so the gravity fitness ring is restrained from inward movement. A groove 42 which is matched with the gravity fitness ring handle 51 and in which the gravity fitness ring handle 51 can be embedded is formed on the outer end surface of the fixing seat.

Furthermore, as shown in FIG. 1-3, a counter bore 43 in which a lock hole lug 7 can be embedded is further formed on the outer end surface of the fixing seat 4, the lock hole lug 7 adopts a cuboid structure and is embedded in a fastened manner into the counter bore 43 to become a part of the fixing seat 4, a certain distance exists between the lock hole lug 7 and the axis of the fixing seat, and a rectangular counter bore 71 as the lock hole is formed on the surface of the lock hole lug 7 facing the axis of the fixing seat, that is, the lower end surface of the lock hole lug, as shown in FIG. 3.

Furthermore, as shown in FIG. 1-3, a counter bore 44 for embedding a hinge lug 8 is further formed on the outer end surface of the fixing seat 4, the hinge lug 8 is embedded in a fastened manner into the counter bore 44 to become a part of the fixing seat 4, and a hinge lug shaft hole 81 penetrating two side surfaces of the hinge lug is formed in the hinge lug 8.

Furthermore, as shown in FIG. 1-3, the fastening lock comprises a lock body 100, a lock tongue 140 and an opening mechanism, wherein, the lock body 100 adopts a cylindrical structure, the diameter of the lock body is identical or similar to that of the outer end surface of the fixing seat, a hinge notch 104 for accommodating the fixing seat hinge lug 8 is formed on the edge of the lock body, a hinge shaft hole 105 penetrating two opposite surfaces of the hinge notch 104 is formed between the two opposite surfaces, and the lock body 100 is movably and rotationally connected with the barbell fixing seat 4 through a hinge mechanism. When the lock body 100 is locked, the inner end surface of the lock body fits the outer end surface of the barbell fixing seat 4 to wrap and fix the gravity fitness ring handle 51 embedded into the fixing seat groove. As shown in FIG. 3, a counter bore 102 for accommodating the fixing seat lock hole lug 7 is further formed on the inner end surface of the lock body 100, the counter bore is matched in shape with the fixing seat lock hole lug 7, and the fixing seat lock hole lug 7 can be smoothly inserted into or separated from the counter bore 102.

Furthermore, as shown in FIG. 1-3, a counter bore 103 for placing the lock tongue 140 is formed on the outer end surface of the lock body, the counter bore 103 is in a transverse rectangular shape, a lock body through hole 107 is formed on the top wall of the counter bore 103 facing the tongue tip of the lock tongue 140, the through hole 107 is matched in dimensions with a counter bore 71 on the lower end surface of the lock hole lug, and when the lock tongue 140 is locked, the upper part of the lock tongue penetrates the through hole 107 and is inserted into the lock hole lug counter bore 21, as shown in FIG. 3. A lug 106 is arranged in the middle of the lock body outer end surface counter bore, the outer end surface of the lock body is further covered with an outer end cover 170 matched with the lock body 100, and the lock body outer end cover 170 is in fastened connection with the lock body 100 through screws 9 and lock body screw holes 101.

Furthermore, as shown in FIG. 1-3, the lock tongue 140 is an inverted T-shaped structure with a certain thickness, the width of the bottom of the lock tongue is matched with the transverse width of the lock body outer end surface counter bore 103, the bottom of the lock tongue is embedded into the counter bore 103, the inner side surface of the lock tongue 140 is in slide fit with the bottom surface of the lock body outer end surface counter bore 103, the lock tongue conducts upward and downward linear movement under the restraint of the two side walls of the lock body outer end surface counter bore 103, lock tongue return springs 150 are propped against the lower end surface of the inverted T-shaped structure of the lock tongue, and the lower end surfaces of the lock tongue return springs 150 are propped against the lower wall of the lock body outer end surface counter bore 103. A lock tongue guide surface 141 is arranged in the position at the upper end of the lock tongue 140 facing the lock body outer end surface counter bore to form the tongue tip of the lock tongue 140. When the fixing seat 4 is locked with the lock body 100, the lock tongue penetrates the lock body through hole 107 to be inserted into the lock hole lug counter bore 71 of the fixing seat to connect the fixing seat 4 and the lock body 100 into a whole. Lock tongue opening lugs extend towards the lock body outer end surface from bulges on two sides at the lower part of the lock tongue 140, and opening guide surfaces 142, that is, inclined surfaces extending towards the lower outer sides, are formed on the lock tongue opening lugs. A strip-shaped lock tongue slot hole 143 penetrating along the axial direction of the lock body is formed at the symmetric center of the vertical part of the lock tongue.

Figure 4:
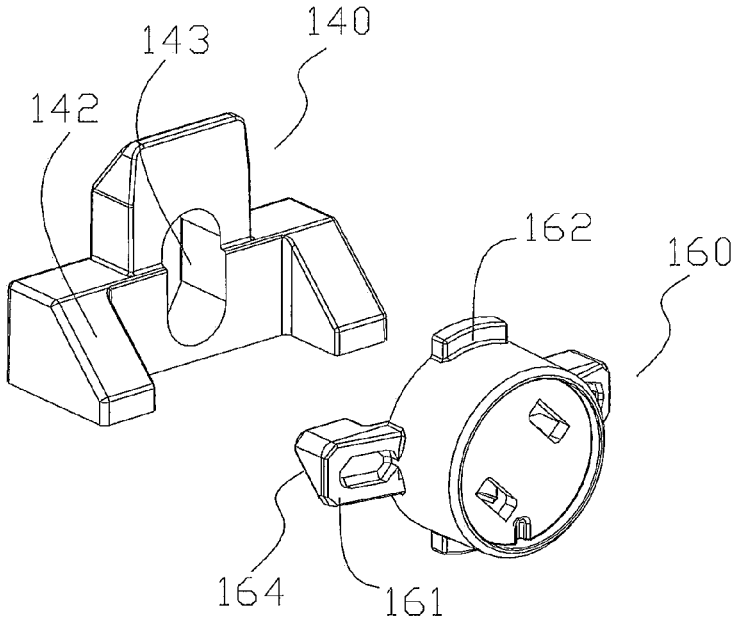
FIG. 4 is the exploded view of the lock tongue and the open button in the fitness barbell.
Figure 5:
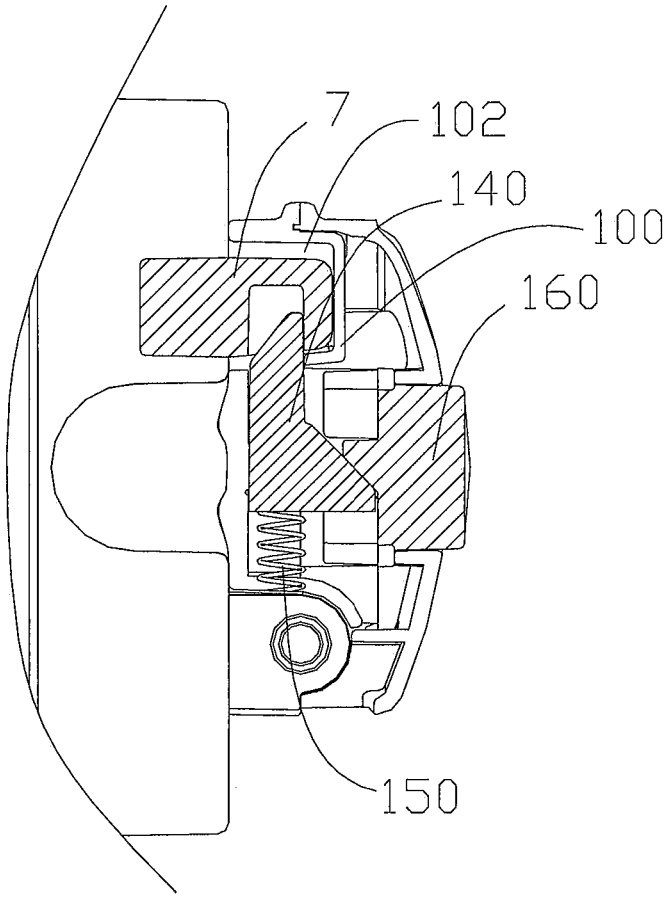
FIG. 5 shows the principles of locking and unlocking between the lock body and the fixing seat in the fitness barbell.

Furthermore, as shown in FIG. 1-3, an open button 160 is used as a fastening lock opening mechanism and adopts a cylindrical structure, a through hole 171 allowing the open button to penetrate in a sliding manner is formed at the central axis of the lock body outer end cover 170, symmetric open button lugs 161 extend radially from the positions of the open button 160 corresponding to the lock tongue opening guide surfaces 142, the open button lugs 161 are provided with opening guide surfaces 164 which are inclined surfaces extending towards the upper inner sides as shown in FIG. 4-5, and after the fastening lock is mounted, the lock tongue opening guide surfaces 142 and the button opening guide surfaces 164 are arranged correspondingly and can slide with respect to each other. Open button claws 162 which extend radially, are symmetric to each other and are spaced from the open button lugs at an interval of 90 degrees are further arranged in the positions of the open button facing the lock tongue outer end surface, the open button lugs 161 and the open button claws 162 are propped against the inner side of the through hole 171 of the lock body outer end cover 170 to prevent the open button 160 from sliding out of the lock body outer end cover, and the other end of the open button is further covered with an end cover 180 convenient to press.

Furthermore, as shown in FIG. 1-3, a lug 163 for fixing an open button return spring 130 is further arranged at the center of the end surface of the fastening lock open button 160 facing the lock body, the button return spring lug 163 is sleeved by one end of the return spring 130, the return spring 130 penetrates the lock tongue slot hole 143, and the lock body outer end surface counter bore lug 106 is sleeved by the other end of the return spring 130. When pressed, the open button 160 drives the lock tongue opening guide surfaces 142 through the button opening guide surfaces 164 to drive the lock tongue 140 to move down in whole, so the lock tongue 140 is separated from the lock hole lug counter bore 71, and the lock body 100 is unlocked from the fixing seat 4. The movement of the lock tongue 140 does not affect the button return spring 130 in the lock tongue slot hole 143. When the open button 160 is released, the open button return spring 130 drives the open button lugs 161 and the claws 162 to be propped against the edge of the through hole 171 of the lock body outer end cover 170 again, so the open button is restored to its original position, and the lock tongue 140 moves up in whole to be locked again.

Furthermore, as shown in FIG. 1, a rotary return spring 120 is arranged between the fixing seat 4 and the lock body 100 and is a cylindrical rotary torsion spring, a lock body hinge shaft 110 is sleeved by the rotary return spring 120, one end of the rotary return spring is in fastened connection with the fixing seat 4 through a hinge return spring fixing groove 82, and the other end of the rotary return spring is in fastened connection with the lock body 100. After unlocked from the fixing seat, the lock body rotates outwards around the hinge, the inner end surface of the lock body is separated from the outer end surface of the fixing seat, and the rotary return spring 120 is compressed, so the gravity fitness ring as the gravity body can be withdrawn from the fixing seat. After the lock body is released, the rotary return spring 120 drives the lock body inner end surface to lean towards the outer end surface of the fixing seat again.

Compared with the prior art, the invention has the following advantages: through the adoption of the ring-shaped gravity fitness ring as the gravity body, multiple purposes can be achieved, and materials are saved; and due to the application of the fastening lock, the gravity body is convenient to mount and detach, and the fastening effect is better.

The above disclosed embodiment is only a specific embodiment of the invention. However, the invention is not limited to this embodiment, and any change that technicians in this field can come up with shall fall into the protection scope of the invention.

The invention claimed is:

1. A fitness barbell comprising a holding rod and a gravity body, wherein the gravity body is a ring-shaped gravity fitness ring, a handle arranged in the diameter direction of the ring-shaped gravity fitness ring is positioned in the ring-shaped gravity fitness ring, the holding rod is fastened detachably with the ring-shaped gravity fitness ring through a connecting mechanism composed of a fixing seat and a fastening lock, and the ring-shaped gravity fitness ring is limited between the fixing seat and a lock body of the fastening lock through a lock tongue of the fastening lock, wherein the fixing seat is in the shape of a stepped cylinder, the low step cylinder of the fixing seat is provided with a groove in the diameter direction and sleeved by the ring-shaped gravity fitness ring, and the gravity fitness ring handle is clamped in the groove;

a lock hole lug is arranged on the outer end surface of the fixing seat, a lock hole lug counter bore is formed on the lower end surface of the lock hole lug, the lock body is provided with a lock body inner end surface counter bore for accommodating the lock hole lug, and a through hole matched in dimensions with the lock hole lug counter bore is formed on the lower wall of the lock body inner end surface counter bore;

the lock tongue is arranged in a lock body outer end surface counter bore, the inner end surface of the lock tongue is closely attached to the bottom surface of the lock body outer end surface counter bore and capable of sliding up and down in the lock body outer end surface counter bore, and lock tongue return springs are arranged between the lower end surface of the lock tongue and the lower wall surface of the lock body outer end surface counter bore;

a lock tongue return spring pushes the lock tongue to move up to enable the upper end of the lock tongue to penetrate the through hole to be inserted into the lock hole lug counter bore, so the fixing seat is locked with the lock body; and when the gravity body is required to be detached, a downward force is applied to the lock tongue to compress the lock tongue return spring and separate the upper end of the lock tongue from the lock hole lug counter bore, so the fixing seat is separated from the lock body.

2. The fitness barbell according to claim 1, wherein lock tongue opening guide surfaces are symmetrically arranged on two sides at the lower part of the lock tongue, an open button is arranged at the outer end of the lock tongue, and button opening guide surfaces are arranged in the positions on the two sides of the open button corresponding to the lock tongue opening guide surfaces; and since the lock tongue opening guide surfaces and the button opening guide surfaces are arranged in a butt joint manner, a horizontal, inward force applied on the open button can be converted into a downward force to the lock tongue to separate the fixing seat from the lock body.

3. The fitness barbell according to claim 2, wherein a lock body counter bore lug is arranged in the middle of the bottom surface of the lock body outer end surface counter bore, a strip-shaped through hole is formed in the corresponding position in the middle of the lock tongue, an open button return spring lug is arranged correspondingly in the middle of the inner end surface of the open button, a horizontally arranged open button return spring is arranged in a penetrating manner in the strip-shaped through hole, the lock body counter bore lug is sleeved by one end of the open button return spring, and the open button return spring lug is sleeved by the other end of the open button return spring.

4. The fitness barbell according to claim 3, wherein the fixing seat is provided with a hinge lug, a hinge notch for accommodating the hinge lug is formed in the corresponding position on the lower side edge of the lock body, and a hinge shaft is arranged in a penetrating manner on the two sides of the hinge notch on the lock body and in a corresponding shaft hole on the hinge lug, so the lower side edge of the lock body is rotationally and movably connected with the fixing seat.

5. The fitness barbell according to claim 3, wherein an axial counter bore matched in diameter with the holding rod is formed at the axial center of the inner end surface of the fixing seat, and the end of the holding rod is inserted into the axial counter bore and fixedly connected with the axial counter bore through a pin.

6. The fitness barbell according to claim 3, wherein an end part of the holding rod is sleeved by a check ring for prompting the holding position.

7. The fitness barbell according to claim 2, wherein a lock body outer end cover for enveloping the lock tongue and the open button is arranged at the outer end of the lock body, the lock body is in fastened connection with the lock body outer end cover, a through hole matched in dimensions with the open button is formed in the center of the lock body outer end cover, and claws are arranged at the upper and lower ends of the open button when the fixing seat is locked with the lock body, the claws are propped against the inner edge of the through hole to prevent the open button from disengaging from the through hole.

8. The fitness barbell according to claim 7, wherein an end cover for making it easier to press the open button is arranged on the outer side of the through hole.

9. The fitness barbell according to claim 1, wherein the fixing seat is provided with a hinge lug, a hinge notch for accommodating the hinge lug is formed in the corresponding position on the lower side edge of the lock body, and a hinge shaft is arranged in a penetrating manner on the two sides of the hinge notch on the lock body and in a corresponding shaft hole on the hinge lug, so the lower side edge of the lock body is rotationally and movably connected with the fixing seat.

10. The fitness barbell according to claim 9, wherein a rotary return spring is arranged between the fixing seat and the lock body and is a cylindrical rotary torsion spring, the hinge shaft is sleeved by the rotary return spring, one end of the rotary return spring is in fastened connection with the fixing seat through a hinge return spring fixing groove, and the other end of the rotary return spring is in fastened connection with the lock body; and after unlocked from the fixing seat, the lock body rotates outwards around the hinge shaft to enable the inner end surface of the lock body to be separated from the outer end surface of the fixing seat.

11. The fitness barbell according to claim 1, wherein an axial counter bore matched in diameter with the holding rod is formed at the axial center of the inner end surface of the fixing seat, and the end of the holding rod is inserted into the axial counter bore and fixedly connected with the axial counter bore through a pin.

12. The fitness barbell according to claim 1, wherein an end part of the holding rod is sleeved by a check ring for prompting the holding position.

* * * * *